US006102056A

United States Patent [19]

Kotsopey

[11] Patent Number: 6,102,056

[45] Date of Patent: Aug. 15, 2000

[54] CLEANING APPARATUS

[76] Inventor: Omelan Kotsopey, 1 Betsy Ct., Yardville, N.J. 08620

[21] Appl. No.: 09/244,147

[22] Filed: Feb. 4, 1999

Related U.S. Application Data

[60] Provisional application No. 60/096,928, Aug. 18, 1998.

[51] Int. Cl.[7] ..... B08B 3/12

[52] U.S. Cl. ..... 134/95.2; 134/99.2; 134/105; 134/186

[58] Field of Search ..... 134/95.2, 99.2, 134/102.3, 105, 186

[56] References Cited

U.S. PATENT DOCUMENTS

| | | |
|---|---|---|
| 3,640,295 | 2/1972 | Peterson . |
| 3,985,344 | 10/1976 | McCord . |
| 4,308,229 | 12/1981 | Voit . |
| 4,448,750 | 5/1984 | Fuesting . |
| 5,141,009 | 8/1992 | Morantz . |
| 5,380,369 | 1/1995 | Steinhauser et al. . |
| 5,403,555 | 4/1995 | Steinhauser et al. . |
| 5,480,302 | 1/1996 | Fife . |
| 5,716,454 | 2/1998 | Carr . |

*Primary Examiner*—Philip R. Coe
*Attorney, Agent, or Firm*—Donald S. Cohen

[57] ABSTRACT

An apparatus for cleaning parts includes a tank having an liquid inlet opening and a liquid outlet opening therein to allow a liquid, such as water to enter and drain from the tank. The tank also includes an air inlet window and an air outlet duct for allowing a flow of air to pass therethrough. An air duct having an air pump connected thereto extends across the outside of the tank between the air outlet duct and the air inlet window to provide a flow of air through the tank. A heater is in the air duct to heat the flow of air. A first overflow wall extends across and spaced from the air inlet window to provide an overflow passage for carrying away any liquid which may overflow the wall and prevent the liquid from entering the air inlet window. A second overflow wall extends across and is spaced from the air outlet duct to form an overflow passage for carrying away any liquid which may overflow the second overflow wall and prevent such liquid from entering the air outlet duct. There are drains at the bottom of the overflow passages to carrying away any liquid which may enter the overflow passages. A basket for containing the articles to be cleaned is provided and can be inserted and supported in the tank. A reservoir for cleaning solution is connected to the tank and includes a metering pump for controlling the amount of cleaning solution fed to the tank. At least one ultrasonic transducer is mounted on the tank for ultrasonically vibrating the liquid in the tank, and a heater is mounted on the tank for heating the liquid.

21 Claims, 3 Drawing Sheets

CLEANING APPARATUS

This application claims the benefit of Provisional application Ser. No. 60/096,928 filed Aug. 18, 1998.

FIELD OF THE INVENTION

The present invention relates to an apparatus for cleaning articles, such as medical and dental instruments, and, more particularly to an apparatus for automatically cleaning articles, i.e, washing, rinsing and drying the articles, in a single operation.

BACKGROUND OF THE INVENTION

In many fields it is desirable to clean small articles prior to their being used. This is particularly true in the medical and dental fields where small medical and dental instruments must be cleaned either before they are used or prior to sterilization of the instruments. Although such articles can be cleaned manually, this is a time consuming operation. Also, manual cleaning does not necessarily thoroughly clean the parts. In order to clean a relatively large quantity of parts in a minimum amount of time, it is desirable to have an apparatus which will thoroughly clean, i.e., wash, rinse and dry, a relatively large bath of the parts in a single automatic and continuous operation.

SUMMARY OF THE INVENTION

An apparatus for cleaning articles includes a tank having an open top for inserting therein the articles to be cleaned. The tank includes a liquid inlet opening and a liquid outlet opening to allow liquid to flow into and out of the tank. The tank also includes an air inlet window and an air outlet duct to allow air to flow through the tank. A first overflow passage is between the air inlet window and the liquid inlet opening to prevent liquid in the tank from entering the air inlet window. A second overflow passage is between the air outlet duct and the liquid outlet opening to prevent liquid in the tank from entering the air outlet duct.

DETAILED DESCRIPTION OF PREFERRED EMBODIMENT

Figure 1:
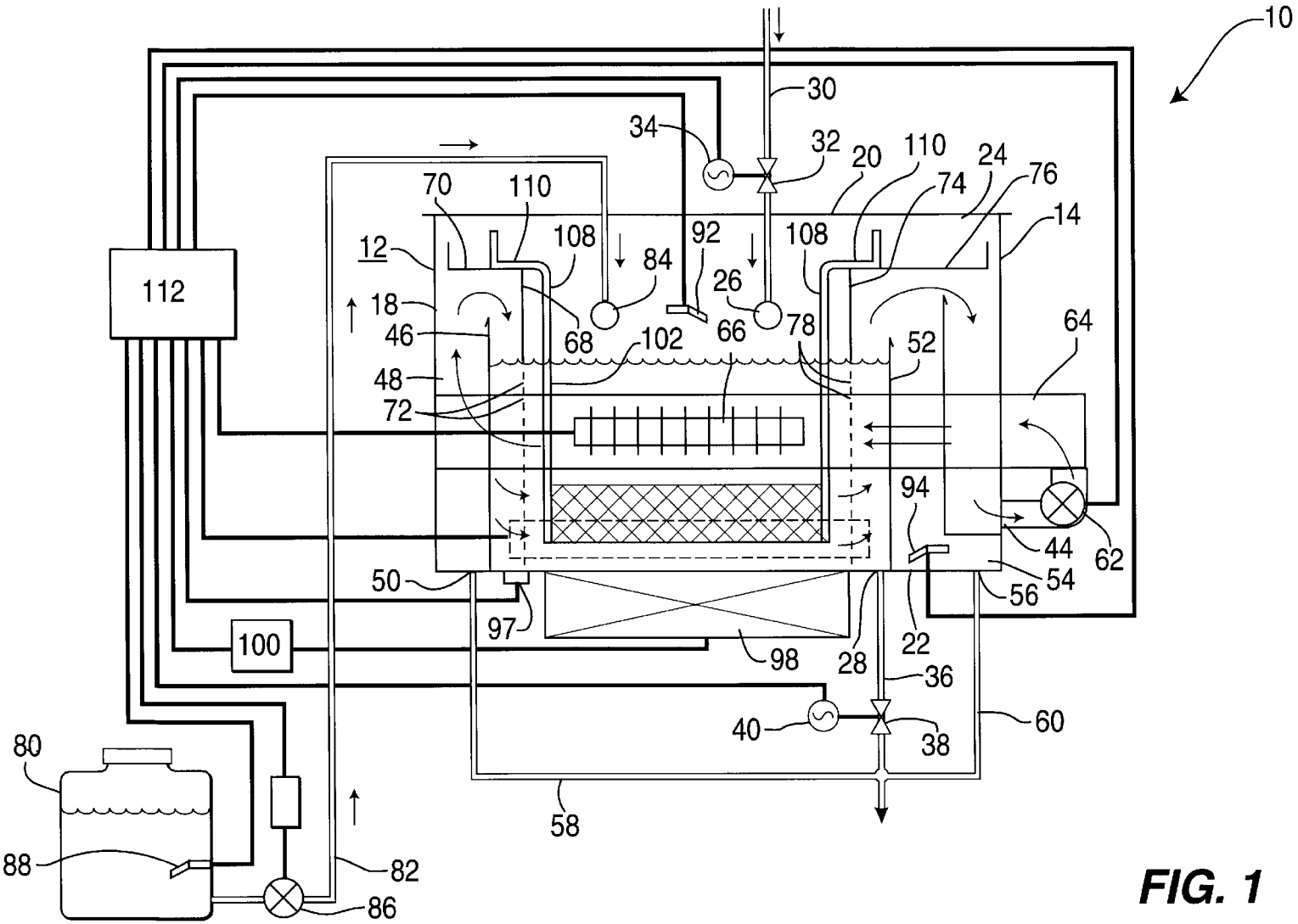
FIG. 1 is a schematic view of the cleaning apparatus of the present invention including the operating system for the apparatus.
Figure 2:
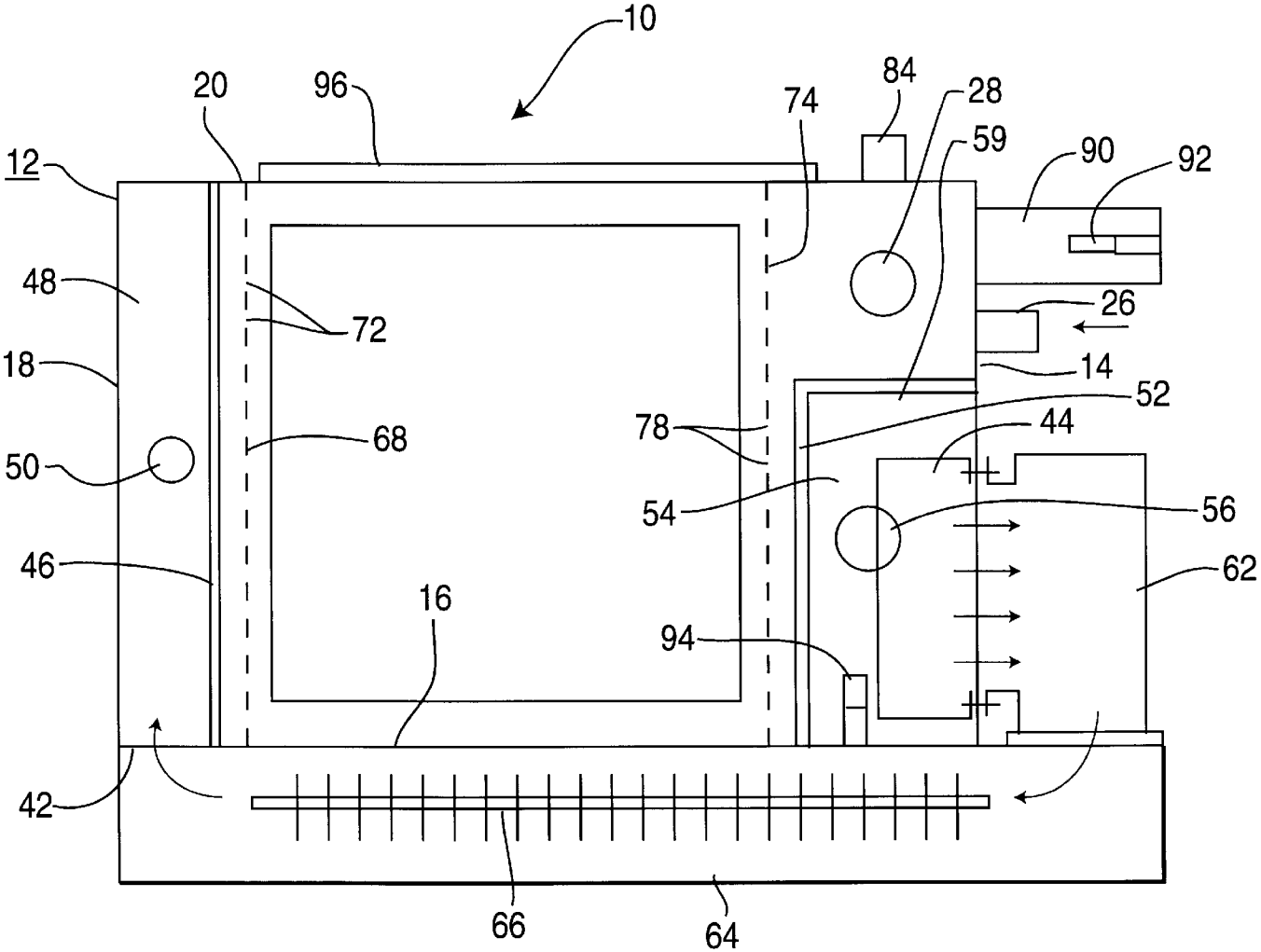
FIG. 2 is a top view of the cleaning apparatus of the present invention.
Figure 3:
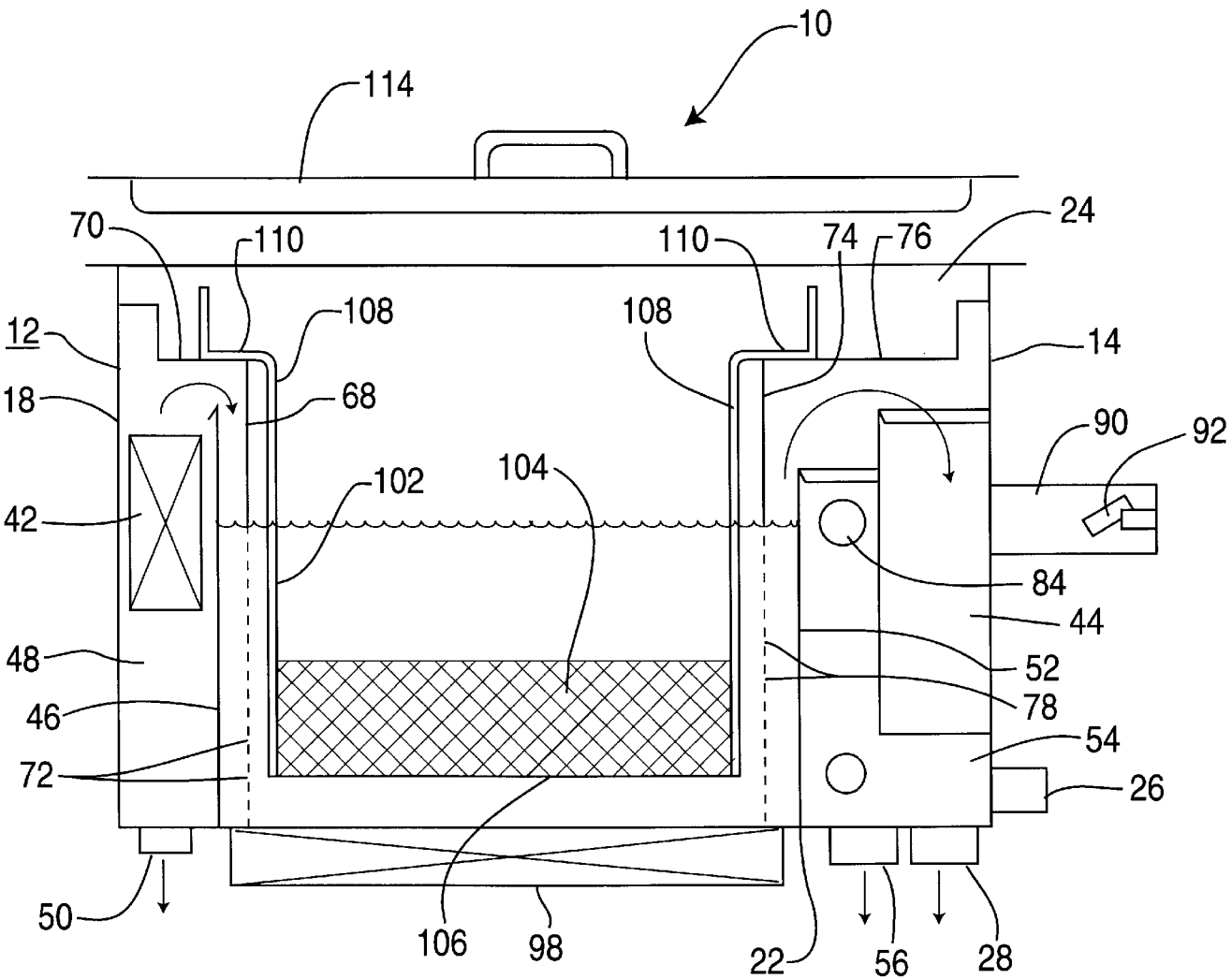
FIG. 3 is a side view of the cleaning apparatus.

Referring to the drawings, the cleaning apparatus of the present invention is generally designated as 10. Cleaning apparatus 10 comprises a rectangular tank 12 having four side walls 14, 16, 18 and 20, a bottom 22 and an open top 24. As shown in FIGS. 2 and 3, a liquid water inlet tube 26 extends through the side wall 14 of the tank 12, and a liquid water outlet drain 28 extends through the bottom 22. As shown in FIG. 1, the water inlet tube 26 is connected to a source of wash and rinse water (not shown) through a pipe 30. In the pipe 30 is a control valve 32 operated by a solenoid 34. Also, as shown in FIG. 1, the water outlet drain 28 is connected to a drain (not shown) by a pipe 36. the pipe 36 contains a control valve 38 operated by a solenoid 40.

An air inlet window 42 is in the side wall 16 of the tank 12 adjacent the side wall 18. An air outlet duct 44 is in the side wall 14 of the tank 12 opposite the side wall 18. A first liquid overflow wall 46 extends upwardly from the bottom 22 of the tank 12 adjacent but spaced from the side wall 18. The first overflow wall 46 extends completely between the side walls 16 and 20 of the tank 12, but does not extend completely up to the open top 24. Thus, the first overflow wall 46 forms a passage 48 between the first overflow wall 46 and the side wall 18 of the tank 12 which contains the air inlet window 42. A drain opening 50 is in the bottom 22 of the tank 12 in the passage 48. A second overflow wall 52 extends upwardly from the bottom 22 of the tank 12 adjacent but spaced from the air outlet duct 44. The second overflow wall 52 does not extend up to the open top 24 of the tank 12. The second overflow wall 52 forms a passage 54 between the second overflow wall 52 and the side wall 14 of the tank 12 which contains the air outlet duct 44. A drain opening 56 is in the bottom 22 of the tank 12 within the passage 54. The drains 50 and 56 are connected by pipes 58 and 60 respectively to the outlet pipe 36 beyond the valve 38.

An air pump 62 is mounted on the outside of the side wall 14 of the tank 12 over the air outlet duct 44. An air duct 64 extends from the air pump 62 across the outside of the side wall 16 of the tank 12 to the air inlet window 42. A fin heater 66 is within the air duct 64. The air pump 62 draws air form the tank 12 through the air outlet duct 44. The air is them pumped through the air duct 64 to the air inlet window 42 where it reenters the tank 12. The air is heated by the heater 66 so as to provide a flow of heated air through the tank 12.

A first air diffuser wall 68 extends from the bottom 22 of the tank 12 and extends between the side walls 16 and 20 of the tank 12. The first air diffuser wall 68 extends parallel to but is spaced inwardly from the first overflow wall 46. The first diffuser wall 68 has a ledge 70 at its top which extends over the passage 48 to the side wall 16 of the tank 12. The first air diffuser wall 68 is solid at its top but has a plurality of holes 72 therethrough at its lower portion. A second air diffuser wall 74 extends from the bottom 22 of the tank 12 and extends between the side walls 16 and 20 of the tank 12. The second air diffuser wall 74 is adjacent to but spaced inwardly from the second overflow wall 46. The second air diffuse wall 74 has a ledge 76 that extends over the passage 54 to the side wall 14. The second air diffuser wall 74 is solid at its top portion and has a plurality of holes 78 therethrough at its lower portion.

A reservoir 80 of cleaning solution is connected through a pipe 82 to an inlet opening 84 in the side wall 20 of the tank 12. A metering pump 86 is in the pipe 82 to provide a controlled amount of cleaning liquid to the tank 12. A level switch 88 is in the reservoir 80 to control the level of the cleaning solution in the reservoir 80. A tube 90 is secured to the side wall 14 of the tank 12 and is open into the tank 12. A liquid level control switch 92 is in the tube 90 to control the level of the liquid in the tank 12. A liquid level control switch 94 is in the passage 54 between the second overflow wall 52 and the side wall 14 of the tank 12. The liquid level switch 94 controls the level of the overflow liquid in the passage 54 by controlling the flow of liquid into the tank 12.

A strip heater 96 is secured to the outer surface of the side wall 20 of the tank 12 to heat the liquid in the tank 12. A thermostat 97 is mounted on the bottom 22 of the tank 12 to control the strip heater 96 and thereby control the temperature of the liquid in the tank 12. One or more ultrasonic transducers 98 are secured to the outer surface of the bottom 22 of the tank 12. The transducer 98 is electrically controlled by a power supply generator 100. A basket 102 for the articles to be cleaned includes sides 104 and a bottom 106 which have openings therethrough to allow fluid and air to pass through the basket 102. Handles 108 extend upwardly from the sides 104 of the basket 102. The handles 108 have ledges 110 at their top ends which are adapted to rest on the ledges 70 and 76 of the air diffuser walls 68 and 74 to support the basket 102 in the tank 12. All of the electrical devices, such as the heaters 66 and 96, the power supply 100 of the transducers 98, the solenoids 34 and 40, the air pump 62, cleaning solution pump 82, and liquid level switches 92 and 94, are all electrically connected to a control device 112, such as a computer or the like, for controlling the operation of the cleaning apparatus 10. A removable cover 114 is provided on the open top 24 of the tank 12.

In the operation of the cleaning apparatus 10 of the present invention, the basket 102 is removed from the tank 12 and the articles to be cleaned are placed in the basket 102. The basket 102 is then placed back into the tank 12 with the ledges 108 of the handles 106 being seated and supported on the ledges 70 and 76 of the air diffuser walls 68 and 74. The cover 114 can then be placed over the open top 24 of the tank 12. The valve 32 is then opened to allow a liquid, such as water, to enter the tank 12 through the liquid inlet tube 26. When the liquid in the tank 12 reaches a desired height, it operates the control switch 92 to operate the solenoid 34 and close the valve 32. The metering pump 86 is turned on the deliver a controlled amount of cleaning liquid from the reservoir 80 to the tank 12 where it mixes with the water in the tank 12 to form a cleaning solution. The strip heater 96 is turned on to heat the cleaning solution in the tank 12, and the ultrasonic transducers 98 are turned on to provide an ultrasonic vibration of the cleaning solution. This provides a good cleaning of the article in the basket 102. The heater 96 is turned off before the transducers 98 are turned on.

After the articles are subjected to the ultrasonically vibrated cleaning solution for a time sufficient to achieve the desired cleaning of the articles, the transducers 98 are turned off. The drain valve 38 is opened to allow the dirty cleaning solution to flow out of the tank 12 through the drain 28 and pipe 36. After all of the dirty cleaning solution is drained from the tank 12, the drain valve 38 is closed and the liquid inlet valve 32 is reopened to allow clean liquid to enter the tank 12. When the tank 12 is filled with the clean liquid, the transducers 98 can then be turned on to ultrasonically vibrate the liquid and thereby rinse the articles which are in the basket 102. After a suitable rinsing time, the transducer 98 is turned off and the drain valve 38 is opened to allow the rinse liquid to flow from the tank 12. If desired, the system can be set up so that the rinsing step can be repeated until a complete rinsing of the articles is achieved.

After the articles are thoroughly rinsed, the air pump 62 is turned on. This causes a flow of air to pass through the air duct 64 to the air inlet window 42 and into the tank 12. The entering air passes between the first overflow wall 46 and the first diffuser wall 68. The air then passes through the holes 62 in the first diffuser wall 68 to spread the flow of air out over the entire tank 12. The air then flows across the tank 12 through the openings in the sides 104 and bottom 106 of the basket 102 to flow across the articles in the basket 102. This results in a drying of the articles. The air then flows through the second diffuser wall 74 and into the air outlet duct 44.

During the flow of air through the tank 12, the heater 66 is turned on to heat the air. This provides a flow of heated air over the articles in the basket 102 to achieve faster drying of the articles. Once the articles are dry, the air pump 62 is turned off, the cover 114 is removed and the basket 102 is removed from the tank 12 to allow the removal of the clean articles from the basket 102.

In the operation of the cleaning apparatus 10, the control device 112 is used to properly operate all of the valves, pumps. switches etc., in their proper sequence to achieve the above described operation of the cleaning apparatus 10. Also, the control device 112 can be set to provide the proper timing for each of the steps. Thus, the entire cleaning operation can be carried out as a single continuous operation. In the operation of the cleaning apparatus 10, if at any time or for any reason, the liquid in the tank 12 becomes so high that it overflows the second overflow wall 52, the liquid will flow down the passage 54 to the bottom 22 of the tank 12 and out of the drain opening 56. If this occurs during the filling of the tank 12, the overflow liquid will operate the switch 94 at the bottom of the passage 54 to close the liquid inlet valve 32 and thereby stop of the flow of liquid into the tank 12. If the liquid overflows the first overflow wall 46, the overflow liquid will flow down the passage 48 to the bottom 22 of the tank 12 and out through the drain 50. Thus, the overflow walls 46 and 52 separate the liquid in the tank 12 from the air inlet window 42 and air outlet duct 44 so that the liquid does not interfere with the flow of air through the tank 12. Also, any overflow of liquid over the overflow walls 46 and 52 is carried away through the drains 50 and 56 so that the overflow liquid does not enter the air duct 64 and interfere with the flow of air through the tank 12.

Thus, there is provided by the present invention a cleaning apparatus for cleaning a plurality of articles at one time with the various steps of the cleaning operation, i.e, washing, rinsing and drying, being carried out as a single continuous operation. Also, the apparatus provides means for separating the liquid in the tank from the air flow system so that the liquid will not interfere with the air flow used for drying the articles. The apparatus also provides means for preventing any overflow of the liquid from entering the air flow system.

What is claimed is:

1. An apparatus for cleaning articles comprising:

a tank having an open top for inserting therein articles to be cleaned;

a liquid inlet opening in the tank;

a liquid outlet opening in the tank;

an air inlet window into the tank to allow air to flow into and across the tank;

an air outlet duct in the tank for allowing the flow of air out of the tank;

a first overflow passage adjacent the air inlet opening to prevent liquid in the tank from passing into the air inlet window; and a second overflow passage adjacent the air outlet duct to prevent liquid in the tank from flowing into the air outlet duct.

2. The apparatus of claim 1 further comprising a separate drain opening in the tank in each of the first and second overflow passages to carry away any liquid which may enter the overflow passage.

3. The apparatus of claim 2 in which the tank has four side walls and a bottom, the liquid inlet opening is in one of the side walls of the tank and the liquid outlet opening is in the bottom of the tank.

4. The apparatus of claim 3 in which the air inlet window is in one of the side walls of the tank and the air outlet duct is in another side wall of the tank opposite the side wall containing the air inlet window so as to provide a flow of air across the tank.

5. The apparatus of claim 4 further comprising an air pump on the outside of the side wall containing the air outlet duct, and an air duct extending along the outside of one of the side wall of the tank and connecting the air pump to the air inlet window to achieve a flow of air through the tank.

6. The apparatus of claim 5 including a heater in the air duct to heat the air passing therethrough.

7. The apparatus of claim 4 in which the first overflow passage is formed by a first overflow wall extending across the tank parallel to but spaced from the side wall of the tank containing the air inlet window, the first overflow wall extending upwardly from the bottom of the tank to a point below the open top of the tank.

8. The apparatus of claim 7 in which the second overflow passage is formed by a second overflow wall which extends across at least a portion of the tank adjacent but spaced from the side wall of the tank containing the air outlet duct and around the air outlet duct, the second overflow wall extending upwardly from the bottom of the tank to a point spaced from the open top of the tank.

9. The apparatus of claim 8 further comprising a first air diffuser wall extending across the tank parallel to but spaced inwardly from the first overflow wall, the first air diffuser wall having a plurality of holes therethrough to allow air from the air inlet window to pas therethrough.

10. The apparatus of claim 9 further comprising a second air diffuser wall extending across the tank adjacent but spaced inwardly from the second overflow wall, the second air diffuser wall having a plurality of holes therethrough to allow air flow across the tank to pas therethrough to the air outlet duct.

11. The apparatus of claim 10 in which each of the first and second diffuser walls has a ledge at its tope end which extends over the adjacent overflow passage.

12. The apparatus of claim 11 further comprising a basket having sides and a bottom which can hold the articles to be cleaned and which can be inserted into the tank.

13. The apparatus of claim 12 in which the sides and bottom of the basket have a plurality of openings therethrough to allow liquid and air to pass through the basket and over the articles contained in the basket.

14. The apparatus of claim 13 in which the basket has a pair of handles extending upwardly from its sides and the handles have ledges which are adapted to seat on the ledges of the air diffuser wall to support the basket in the tank.

15. The apparatus of claim 2 further comprising a drain pipe extending from the liquid outlet opening in the tank and a solenoid operated valve in the drain pipe for controlling the flow of liquid from the tank.

16. The apparatus of claim 15 further comprising a separate drain pipe extending from each of the overflow drains and connected to the drain pipe beyond the valve.

17. The apparatus of claim 1 further comprising a liquid inlet pipe connected to the liquid inlet opening and a solenoid operated valve in the liquid inlet pipe for controlling the flow of liquid into the tank.

18. The apparatus of claim 17 further comprising a liquid level control switch in the tank for controlling the valve when the level of the liquid in the tank reaches a desired level.

19. The apparatus of claim 1 further comprising a reservoir for a cleaning solution and a pipe connecting the reservoir to an inlet opening in a side wall of the tank, and a metering pump in the pipe for controlling the amount of cleaning solution fed to the tank.

20. The apparatus of claim 1 further comprising an ultrasonic transducer mounted on the outside of the tank for ultrasonically vibrating the liquid in the tank.

21. The apparatus of claim 20 further comprising a heater mounted on the outside of the tank for heating the liquid in the tank.

* * * * *